United States Patent [19]

Mauch

[11] Patent Number: 4,911,581

[45] Date of Patent: Mar. 27, 1990

[54] PRE-CAST CONCRETE PILE AND METHOD AND APPARATUS FOR ITS INTRODUCTION INTO THE GROUND

[75] Inventor: Magnus Mauch, Goppingen, Fed. Rep. of Germany

[73] Assignee: Delmag Maschinenfabrik Reinhold Dornfeld GmbH & Co, Fed. Rep. of Germany

[21] Appl. No.: 51,689

[22] Filed: May 20, 1987

[30] Foreign Application Priority Data

May 21, 1986 [DE] Fed. Rep. of Germany ..... 3617025

[51] Int. Cl.[4] ..... E02D 7/22; E02D 5/56

[52] U.S. Cl. ..... 405/232; 405/231; 405/254; 405/256; 175/19; 175/121; 173/11; 173/12

[58] Field of Search ..... 405/228, 231, 232, 244, 405/245, 249, 251–256; 175/19, 113, 121, 122, 162, 203; 173/11, 12, 39, 42, 43, 44

[56] References Cited

U.S. PATENT DOCUMENTS

| | | | |
|---|---|---|---|
| 3,277,968 | 10/1966 | Grimaud . | |
| 3,327,789 | 6/1967 | Furuseth | 173/42 X |
| 4,147,457 | 4/1979 | Washida | 405/232 |
| 4,614,462 | 9/1986 | Itou | 405/232 |
| 4,621,950 | 11/1986 | Kinnan | 405/231 |
| 4,708,530 | 11/1987 | Faber | 405/245 X |

FOREIGN PATENT DOCUMENTS

| | | | |
|---|---|---|---|
| 501464 | 4/1920 | France . | |
| 2369388 | 5/1978 | France . | |
| 19417 | 2/1982 | Japan | 405/232 |
| 138613 | 8/1984 | Japan . | |
| 286605 | 1/1971 | U.S.S.R. | 405/232 |
| 28888 | of 1912 | United Kingdom . | |
| 609613 | 10/1948 | United Kingdom . | |
| 849413 | 9/1960 | United Kingdom . | |
| 1125853 | 9/1968 | United Kingdom . | |
| 1552162 | 9/1979 | United Kingdom . | |

*Primary Examiner*—Randolph A. Reese
*Assistant Examiner*—John A. Ricci
*Attorney, Agent, or Firm*—Fred Philpitt

[57] ABSTRACT

An apparatus for screwing a concrete pile (10) into ground comprises a rotary drive (26, 40, 42) and a linear drive (46, 48) both acting on the pile. An angle indicator (58) is associated to the rotary drive (26, 40, 42) and a linear position indicator cooperates with the linear drive (46, 48). A control unit (60) receives the output signals of the angle indicator (58) and the linear position indicator (56) and provides control signals to the rotary drive (26, 40, 42) and the linear drive (42, 48) corresponding to the pitch of the helical rib (16) formed on the concrete pile (10).

6 Claims, 5 Drawing Sheets

PRE-CAST CONCRETE PILE AND METHOD AND APPARATUS FOR ITS INTRODUCTION INTO THE GROUND

The invention relates to a pre-cast concrete pile and a method and apparatus for driving it into the ground.

Hitherto, two alternatives existed for pile foundations: either a hole was drilled in the ground at the desired point, which was filled with concrete in situ, or a pre-cast concrete pile was driven into the ground using a ram. The first alternative is time-consuming, the second alternative involves greater nuisance as regards noise.

It was already proposed (Journal "Baumaschine und Technik", (Construction Equipment and Technology) 9th volume, 1962, pages 253 onwards), to screw a pre-cast concrete pile into the ground in a manner similar to a self-tapping screw. The forces necessary for this are produced on the one hand by constantly exerting an axial pressure on the concrete pile, which produces no noises, partly by rotating the concrete pile, which involves only a slight nuisance as regards noise. In other words; when screwing-in a concrete pile, the force necessary for pushing the pile into the ground is derived for the most part from a rotary movement, the conversion into an axial force being produced by the helical rib arrangement. The rotation of the pile about its longitudinal axis also has the effect that only the relatively low sliding friction between the pile and the earth must be overcome. On the other hand, when driving-in piles, at the time of each impact, the high static friction between the outer surface of the pile and the earth must be interrupted. This static friction is therefore very great, because that part of the earth, into which the pile penetrates, must be displaced in the lateral direction, so that in the immediate vicinity of the pile, the earth is highly compressed and is under high tension. In so far a the conversion of the rotary drive movement into an axial feed movement cannot be achieved by the helical rib arrangement driving the beginning of driving-in), when the pile first of all engages only slightly in the earth; loose or very soft earth), the necessary axial feed force can be provided directly by a linear drive acting on the upper end of the concrete pile, for example by a hydraulic cylinder.

As regards the development of noise, the screwing-in of concrete piles is thus comparable with that of the alternative discussed at the beginning, in which a hole is drilled and the latter is filled with concrete in situ. However, it can be carried out much more quickly at the installation site, in particular the mechanical expenditure and the amount of time, which must be taken for removing the drill cuttings, the drill or the tubular shuttering for the pile, is dispensed with. Piled foundations may thus be concluded in a very quick time, the piles which are driven into the ground being immediately capable of carrying a load. In the case of building work which is to be carried out in the vicinity of buildings or roads, there is thus a considerable reduction of the nuisance emanating from the work. Piles may even be driven in with a steep inclination with respect to the vertical.

In common with the second alternative discussed at the beginning, in which pre-cast concrete piles are driven into the ground, screwing-in has the advantage that the quality of each individual concrete pile can be controlled and monitored more accurately in the case of pre-casting in a factory.

When screwing concrete piles with a helical rib arrangement into the ground, very high torques must frequently be transmitted by the pile. Due to the present invention, it is therefore intended to develop a concrete pile so that it is particularly capable of transmitting high torque from its upper, driven end to its lower end.

The pile construction according to the invention ensures that high torque exerted on the upper end of the pile is reliably transmitted downwards in the pile, since a torque of this type would have the result that the helical reinforcing member attempts to contract (close up in the case of a coil spring), due to which the volume of concrete enclosed by the latter is subject to a compressive load. However, the concrete material is well able to withstand compressive loads of this type, so that overall a reliable transmission of torque in the concrete pile is guaranteed.

Advantageous developments of the invention are described hereinafter.

A concrete pile according to one embodiment contains only as much reinforcement as is necessary for transmitting the torque to a point in question of the pile. Overall tne pile can thus be produced economically.

The development of the invention according to another embodiment facilitates the use of the invention even in hard and stony sub-soils. Generally it is sufficient if solely the lowermost threads of the helical rib arrangement are provided with a wear-resistant, cap-like protective bar protecting their backs.

The development of the invention according to another embodiment is an advantage with regard to free-cutting of "threads" in the earth and also with regard to arresting the pile driven into the earth in the angular direction in the interruptions, first of all when introducing the pile in the radial outwards direction, resiliently displaced earth may spring back, when the rotary movement exerted on the pile is terminated.

The latter advantage is also achieved by the development of the invention according to another embodiment.

According to the another embodiment, a concrete pile having a great length overall may be driven into the ground in several segments lying axially one behind the other, in succession, which makes it possible to use a screwing-in apparatus with a small working stroke, which is cheaper to produce and easier to transport.

The development of the invention according to another embodiment is an advantage with regard to the use of the solution according to the invention in sub-soils of this type, in which a mere rotation of the concrete pile at least in the first stage of its penetration into the earth would have the result that the rib arrangement pulverises the earth in a manner similar to that of a milling cutter, so that no guidance of the rib arrangement in the earth would be obtained.

According to another embodiment, with the penetration concrete pile into the sub-soil, one simultaneously obtains information about how securely the pile is in fact seated in the sub-soil. Namely with peripheral lubrication of the pile, the torque measured is associated directly with the penetration force of the pile in the sub-soil, which in turn once more gives tne load-carrying capacity of the pile; if the pile is not lubricated on the periphery, then the measured torque is representative of the penetration resistance, as already explained, in combination with the peripheral static friction between the pile and earth. Also these forces are again characteristic of the later load-carrying capacity of the pile. When using the method according to the invention, one is thus not bound to overall estimates and the results are not exactly bound to test bores carried out at the insertion point of a pile.

The invention will be described in detail hereafter with reference to various embodiments referring to the drawings, in which.

Figure 1:
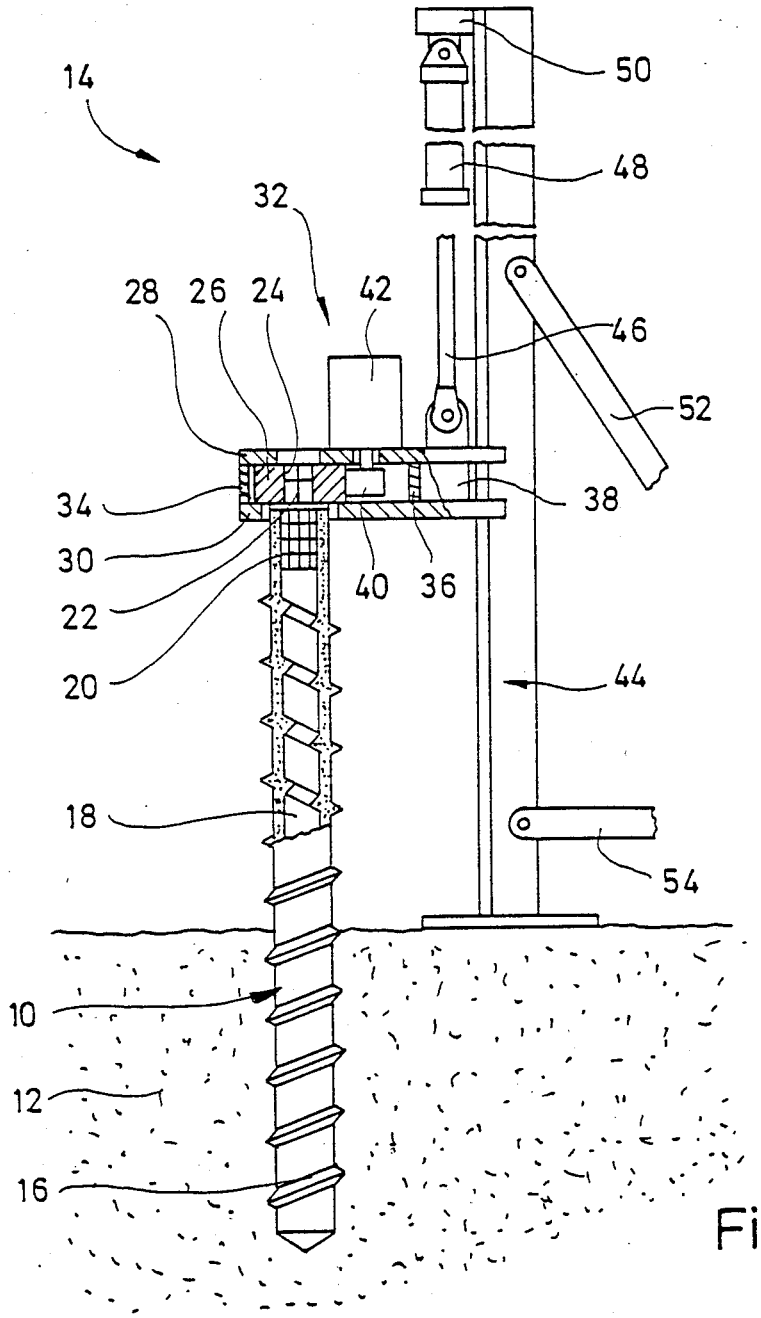
FIG. 1 is a side view, partly in section, of a precast concrete pile and of an apparatus for rotating this pile into tne ground.

FIG. 1 shows a pre-cast concrete pile screwed partly into sub-soil 12. The apparatus used for this, which exerts an axial force on the concrete pile 10 and rotates the latter simultaneously about its longitudinal axis, is designated generally by the reference numeral 14 in FIG. 1.

The concrete pile 10 has a helical rib 16 extending on its outer periphery and is provided on the inside with a helical reinforcement part 18. The latter is illustrated in the drawing as if it were produced from a band; in practice the reinforcement part 18 may be produced in a conventional manner from bent and overlapping reinforcing rods, like conventional reinforcements of concrete piles. In addition to the reinforcement part 18, the concrete pile 10 may comprise further reinforcement parts not shown in the drawing, which in known manner comprise reinforcing rods extending in the axial direction and extending in the peripheral direction.

The upper end of the reinforcement part 18 is welded to a cage-like reinforcing head 20, which is in turn fixed to a driving square bar 22.

The driving square bar 22 is located in a form-locking manner in a driving opening 24 of a driving rim 26. The latter is arranged to rotate and is supported axially between two end plates 28, 30 of a drilling head designated generally by the reference numeral 32. The end plates 28, 30 are kept at a distance apart by a front end plate 34 and a rear end plate 36 and by side plates 38, and together with the latter define a transmission chamber. Rotating in the latter is a pinion 40 meshing with the drive rim 26, which pinion is seated on the shaft of a revolving hydraulic motor 42.

The hydraulic motor 42 includes a torque sensor 43 providing an output signal being representative for the torque required for driving-in the concrete pile 10.

The entire drilling head 32 can be moved by way of extensions of the side plate 38 on a derrick 44. For this purpose, attached to the upper end plate 28 is the piston rod 46 of a long hydraulic working cylinder 48, whereof the housing is supported on a cantilevered arm 50 of the upper end of the derrick 44.

The derrick 44 itself is connected by way of attached struts 52, 54 to a vehicle which is not shown and can be transported by the latter from one installation point to the other. The derrick 44 can also be adjusted as regards its inclination by moving the struts 52, 54.

Figure 2:
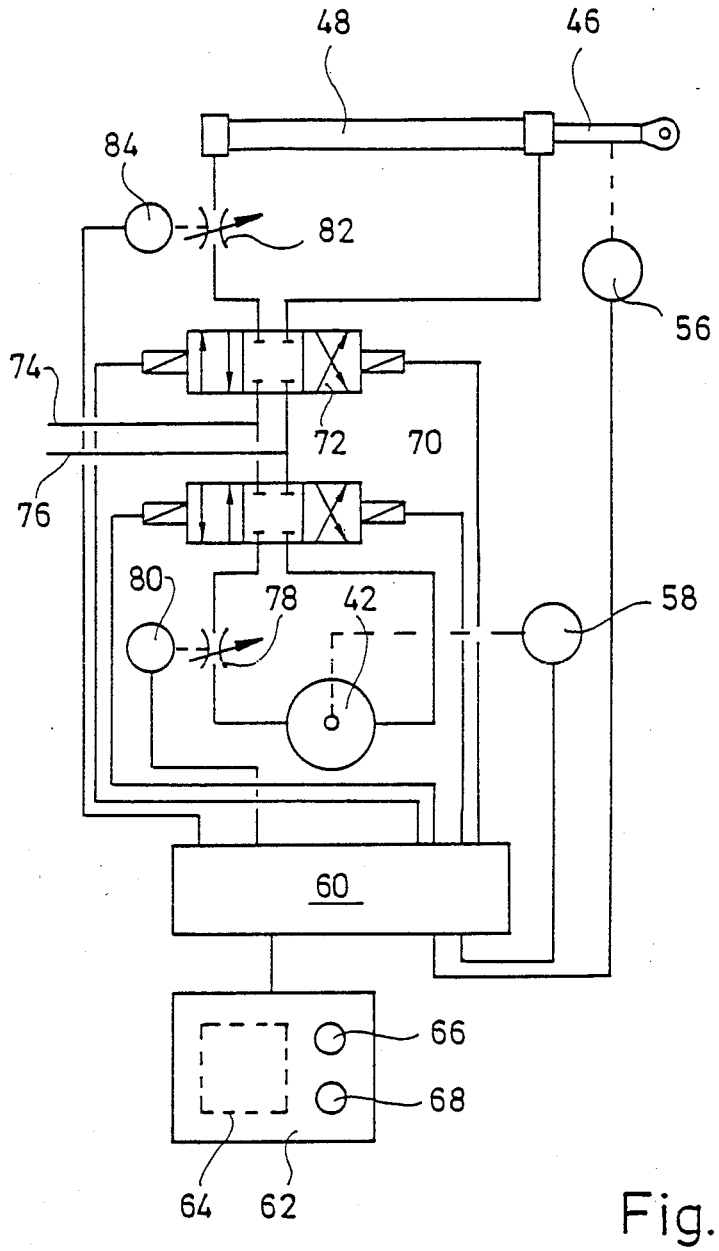
FIG. 2 is a diagrammatic block circuit diagram of the hydraulic system of the apparatus shown in FIG. 1.

As shown in FIG. 2, a linear position indicator 56 is connected mechanically to the piston rod 46 or a part moving rigidly together with the latter. Similarly, the rotation of the driving rim 26 is monitored by an angle indicator 58 connected mechanically to the shaft of the hydraulic motor 42, which angle indicator may be formed by a multiple-turn potentiometer or a stroboscopic disc with subsequent counter.

The position indicator 56 and the angle indicator 58 are connected to the inputs of a control unit 60, in the same way as an operating panel 62, which in addition to an input area 64 for general working parameters, comprises an adjusting knob 66 for the pitch of the rib 16 and an adjusting knob 68 for the length of the concrete pile. The adjusting knobs 66 and 68 have only been shown separately in order to emphasise the associated input quantity. It will be understood that if necessary, these quantities can be fed in in exactly the same way by way of the general input panel, which in addition to control keys may comprise an alpha-numeric keyboard. Belonging to the working parameters which are generally fed in is in particular the reference speed selected with regard to tne firmness of the ground, at which the concrete pile 10 is to be screwed into the sub-soil 12.

Two 4/3 magnetic valves 70, 72 are controlled by way of the control unit 60, by way of which valves the hydraulic motor 42 or the working cylinder 48 for the drive in both working directions can be connected to a pressure line 74 coming from a hydraulic pump which is not shown or to a return line 76 leading to a pressure medium sump which is not shown.

As shown in FIG. 2, an adjustable restrictor 78 is incorporated in a feed line to the hydraulic motor 42, which restrictor is adjusted by a servo-motor 80. Similarly, an adjustable restrictor 82 is incorporated in the feed line leading to the rear working chamber of the working cylinder 48, which restrictor 82 is adjusted by a servo-motor 84.

The two servo-motors 80 and 84 are excited by the control unit 60 so that the helical movement imparted to the upper end of the concrete pile has the same pitch as that of the rib 16.

In this case, the control unit 60 preferably operates so that first of all it attempts to adjust the feed speed at the piston rod 46 corresponding to the reference speed. On the other hand, the speed of rotation of the hydraulic motor 42 is regulated depending on the actual displacement covered by the piston rod 46 and measured by the position indicator 56.

Due to this compulsory synchronisation of the axial movement and rotary movement of the concrete pile 10 it is ensured that the latter is screwed into the sub-soil 12 and no free spaces are created around the concrete pile.

The control of the speed of the hydraulic motor 42 by the actual displacement of the piston rod 46 preferably takes place at least until a few threads of the rib 16 have engaged in the sub-soil and by merely continuing to rotate the concrete pile 10, on account of the support of the ribs, the axial force necessary for displacing the earth can be produced. In this case, the method of operation of the control unit 60 may be varied so that first of all it primarily adjusts the speed of rotation of the hydraulic motor 42 according to the desired feed speed for the concrete pile 10, while the working cylinder 48 is supplied with pressure medium as far as this is necessary for providing the possible remainder of the axial feed force (according to the lagging of the actual position of the piston rod 46 compared with a reference position, which results from the entire angle of rotation of the concrete pile 10 taking into consideration the pitch of the rib 16).

For piled foundations, using the above-described concrete pile and the above-described apparatus, first of all the concrete pile is produced in a factory, in which case the driving square bar 22, the reinforcement member 18, the reinforcement head 20 as well as further reinforcement components are pre-fabricated in known manner and connected to each other securely by welding. The unit obtained in this way is introduced into a mould with an inner contour corresponding to the desired outer contour of the concrete pile 10. The concrete is then poured into this mould and when sufficient inherent strength of the concrete has been obtained, the concrete pile 10 can be removed from the mould. When using a divided mould, this may take place by removing the mould cover and extracting the finished pile; when using an integral mould, in which the inner surface of the mould is coated with a release agent, then the finished concrete pile 10 is screwed out of the mould.

The concrete piles produced in this way may be solid piles, however, by using a rotating mould one can also produce hollow centrifugally cast concrete piles. It will also be understood that when producing the concrete piles 10, the reinforcement may also be placed under tension, so that one obtains pre-stressed concrete piles.

The concrete piles produced in this way and in practice having a length of between 10 and 20 meters are conveyed by vehicle to the building site. At this point, a pile is then respectively placed by a lifting appliance, such as is normally provided on drilling equipment for handling drilling tubes, with the drilling head 32 raised, under the latter and is aligned substantially vertically. The drilling head 32 is then lowered, so that the driving square bar 22 is introduced into the driving rim 26. The lifting appliance can now be released.

With the pile first of all aligned in the vertical direction, the hydraulic motor 42 and the working cylinder 48 are now set in operation until the tip of the pile has been driven so far into the sub-soil that it no longer deflects in the lateral direction. Now, by adjusting the struts 52, 54, the derrick 44 is inclined in that direction in which the concrete pile 10 is to be screwed into the sub-soil. Then, the hydraulic motor 42 and the working cylinder 48 are again supplied with pressure medium, controlled by the control unit 60 and the concrete pile 10 is screwed into the sub-soil 12 quickly in the manner already accurately described above. In practice it is possible to screw in a pile having a length of approximately 12 meters in a total of 6 minutes (main time) into a sub-soil of average heaviness, so that in the case of piled foundations with closely adjacent piles, one reaches a capacity of approximately 10 piles per hour.

Figure 3:
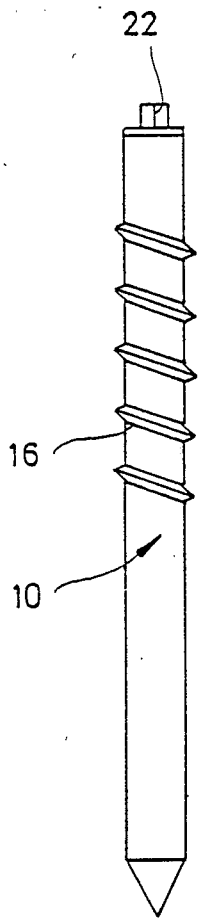
FIGS. 3 to 5 are side views of modified concrete piles, which can be rotated into tne ground.

FIG. 3 shows a modified concrete pile 10, in which the helical rib 16 extends solely over part of its axial length. A pile of this type is used when the uppermost layer of earth is very hard and must be overcome by pile-driving. However, during the second stage of introduction into the sub-soil, one still achieves the advantages obtained with rotating a concrete pile into the sub-soil, thus resulting in still considerable savings as regards time and a considerable reduction of the nuisance with regard to noise.

Conversely, one can also provide solely the lower pile section with a helical rib, in which case the empty screw thread remaining at the upper pile section can be filled with liquid concrete in the sub-soil, if this should be necessary.

Figure 4:
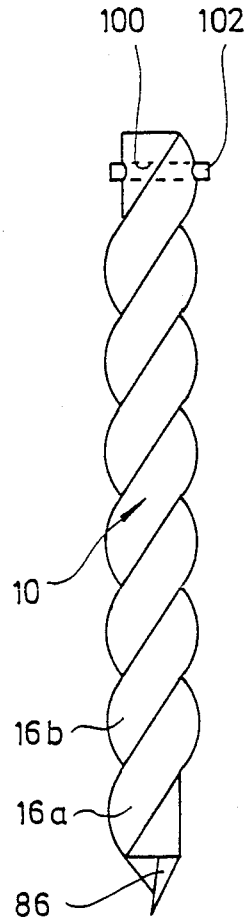

The concrete pile illustrated in FIG. 4 differs from the afore-described embodiments on the one hand due to the fact that it comprises a cutting tip 86, which can cut through hard layers of sub-soil.

Furthermore, one has a double-thread rib arrangement consisting of two ribs **16*a* and 16*b* offset with respect to each other in the peripheral direction by 180°, these ribs also being very wide and cambered. In the embodiment illustrated in FIG. 4, the width of the base of the ribs corresponds to half the pitch of the helix, so that the two ribs 16*a* and 16*b*** nesting one in the other are in contact with each other. The rib profile is circular. A concrete pile having a peripheral contour of this type is particularly well suited for insertion in springy sub-soil, which can spring back in the recesses defined by the ribs.

Figure 5:
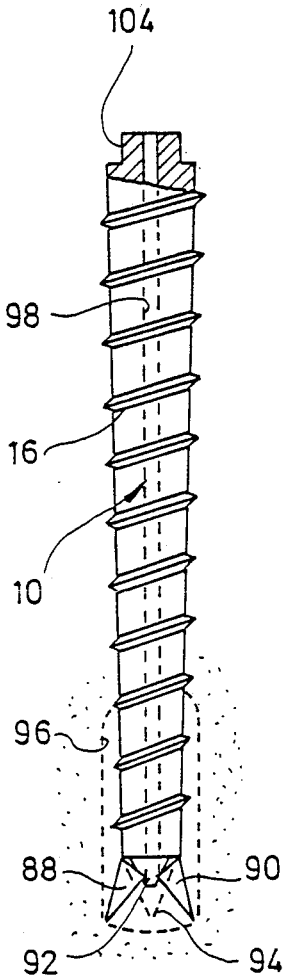

The concrete pile shown in FIG. 5 differs from the afore-described embodiments on the one hand due to the fact that its main body is constructed to be slightly conical, namely it tapers towards the lower end. Thus even the upper sections of the rib 16 still perform radial displacement work when they enter the recesses in the sub-soil already cut by the lower rib sections.

In addition, the concrete pile 10 according to FIG. 5 has a tip, in which semi-conical cutting tools 88, 90, which can be folded back, are provided. The latter can be located on a frustoconical seat 92 formed at the lower end of the pile, so that they form the closed conical tip 94 shown in broken line in FIG. 5. In the position folded away from the seat 92, which is shown in full line in FIG. 5, the cutting tools 88, 90 produce a free space 96, which according to the instant at which the cutting tools are moved out, extends over a smaller or larger portion of the lower end of the concrete pile.

The free space 96 may be filled with liquid concrete by way of an axial passage 98 in the concrete pile and— if desired— expanded due to the actuation of pressure to form an enlarged bulb.

The embodiments according to FIGS. 4 and 5 differ from the afore-described embodiments due to the connection between the upper end of the pile and the drilling head 32, which transmits torque.

The concrete pile according to FIG. 4 has at the upper end a transverse hole 100, in which a steel pin 102 is inserted. The latter cooperates with complementary grooves in the inner peripheral surface of a correspondingly modified driving rim. In the concrete pile shown in FIG. 5, a square bar 104 having a large edge length is formed on the upper end of the pile itself.

It will be understood that further modifications of the above-described embodiments can be obtained due to the fact that the described main parts of the pile, tips and form-locking means are arranged in another combination.

Figure 6:
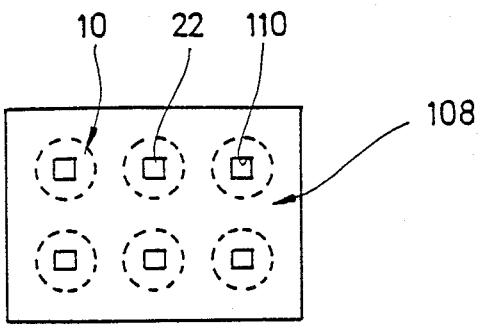
FIG. 6 is a view of a common head plate, by which the form-locking means supported by tne upper ends of adjacent, concrete piles are connected by a wrench.

As shown in FIG. 6, the driving square bars 22 of adjacent concrete piles 10, which were all screwed to the same extent into the sub-soil 12, can be securely connected by a common head plate 108, which comprises recesses 110, in which a driving square bar 22 is located in a form-locking manner.

Figure 7:
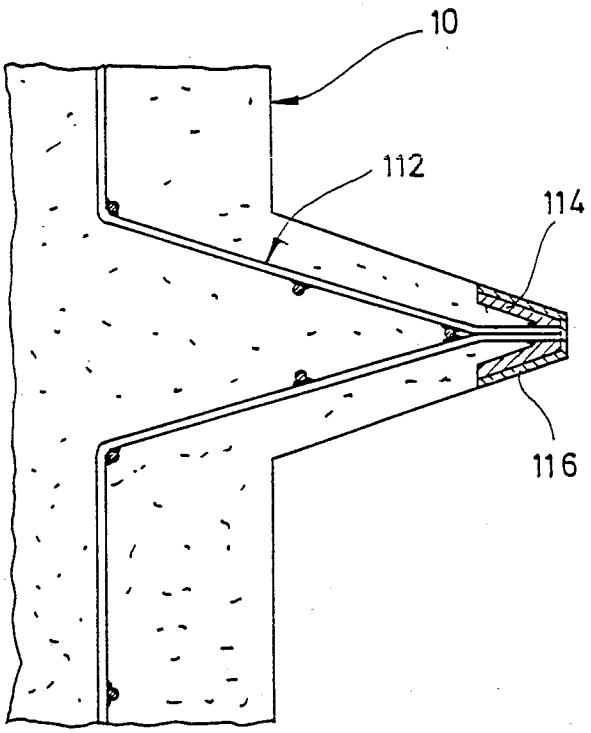
FIG. 7 is an enlarged partial section through one of the ribs of tne concrete pile shown in FIG. 1 and FIGS. 8 and 9 are cross sections through concrete piles with rib geometry varying in the peripheral direction.

As can be seen from FIG. 7, a reinforcing section 112 of the concrete pile 10 can be drawn partly into the rib 16, in order to increase the dynamic strength of the rib 16. In addition, a helical protective bar 114 can be attached to the end of this reinforcing section 112 lying radially on the outside, which bar is provided with an external deposit-welded wear-resistant layer 116. Since the protective bar 114 is already attached to the reinforcing section 112 before the casting of the pile, its outer surface passes flush into the outer surface of the concrete. The protective bar 114 facilitates the cutting of threads in the sub-soil and generally only needs to be provided in the lower section of the concrete pile, since the part of the rib 16 located there has to perform the major part of the cutting and displacement work and is in contact with the sub-soil for the longest time.

Figure 8:
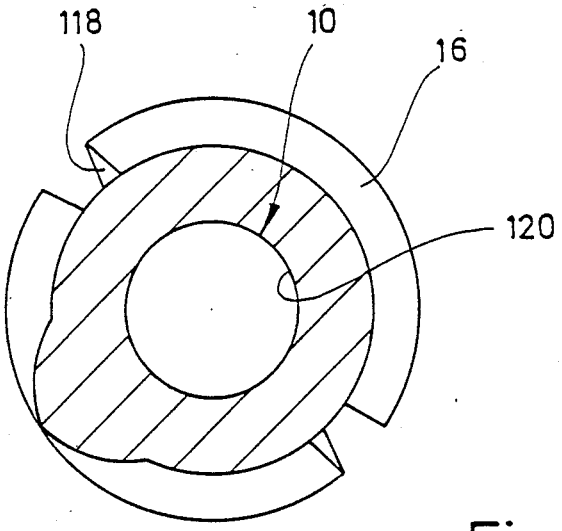

As shown in FIG. 8 in the example of a rib 16 having a substantially triangular cross section, the rib 16 can be interrupted. In the embodiment illustrated, two diametrically opposed interruptions 118 are provided for each thread of the rib 16. When screwing the concrete pile 10 into the sub-soil 12, these interruptions are of importance in so far that they represent additional cutting edtges. However, after the completion of screwing-in, material of the sub-soil may spring into the interruptions 118, so that the concrete pile 10 is additionally arrested in the direction of rotation.

The concrete pile 10 shown in FIG. 8 has an internal axial passage 120, through which a lubricant can be forced from the upper end of the pile to the tip of the pile and from there to the periphery of the pile. A central passage of this type does not appreciably reduce the areal moment of inertia of the pile and thus its capacity to transmit torque; even the static load-carrying capacity in the axial direction is only slightly reduced. After the concrete pile 10 is completely introduced into the earth, the passage 120 is filled with concrete.

Figure 9:
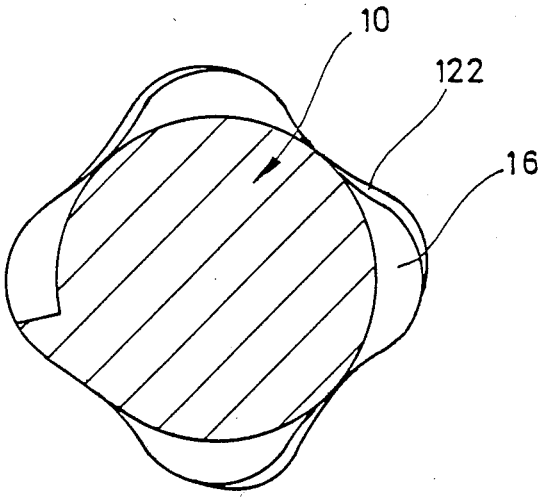

One achieves the last-named advantage even in the embodiment according to FIG. 9, in which the rib 16 has an undulating edge 120 seen in axial view.

What is claimed:

1. Apparatus for screwing as concrete pile into the ground, said concrete pile having a helical rib arrangement on its exterior surface, said apparatus comprising:

(a) drive means (26, 40, 42), for rotatably driving a concrete pile into the ground which includes engaging means (24) that is adapted to engage the upper end (22) of a concrete pile (10), (b) positioning means (46, 48) for moving said drive means (26, 40, 42) along the axis of rotation with respect to the ground, (c) an angle indicator (58) associated with said drive means (26, 40, 42), (d) a linear position indicator (56) associated with said positioning means (46, 48), (e) a control unit (60) for receiving output signals from said angle indicator (58) and said linear position indicator (56) and then generating output signals which control said drive means (26, 40, 42) and said positioning means (46, 48).

2. Apparatus according to claim 1 wherein said drive means (26, 40, 42) and said positioning means (46, 48) are hydraulic motors and said control unit (60) includes servo-restrictors (78, 80, 82, 84), which are connected in one of the connecting lines of said drive means (26, 40, 42) and said positioning means (46, 48).

3. Apparatus according to claim 1 which includes a sensor for the torque necessary for driving-in said concrete pile.

4. Apparatus according to claim 3 wherein the output signal of said torque sensor is used for specifying an insertion speed.

5. Apparatus according to claim 2 which includes a sensor for the torque necessary for driving-in said concrete pile.

6. Apparatus according to claim 5 wherein the output signal of said torque sensor is used for specifying the reference insertion speed.

* * * * *